United States Patent [19]

Andrews et al.

[11] Patent Number: 4,741,770

[45] Date of Patent: May 3, 1988

[54] ZINC SMELTING PROCESS USING OXIDATION ZONE AND REDUCTION ZONE

[75] Inventors: Barry S. Andrews, Victoria; James D. Iley; Mark I. Hoschke, both of New South Wales; Gregorey J. Hardie; Michael J. Hollitt, both of New South Wales, all of Australia

[73] Assignee: CRA Services Limited, Melbourne, Australia

[21] Appl. No.: 847,342

[22] Filed: Apr. 2, 1986

[30] Foreign Application Priority Data

Apr. 3, 1985 [AU] Australia ..... PH0002

[51] Int. Cl.[4] ..... C22B 19/20

[52] U.S. Cl. ..... 75/23; 75/24; 75/40; 75/86; 75/69; 75/71; 75/84

[58] Field of Search ..... 75/21, 23, 24, 86–88, 75/92, 69, 71

[56] References Cited

U.S. PATENT DOCUMENTS

| | | | |
|---|---|---|---|
| 3,892,559 | 7/1975 | Quarm | 75/21 |
| 4,252,560 | 2/1981 | Vanjukov et al. | 75/88 |
| 4,414,022 | 11/1983 | Melcher | 75/26 |

FOREIGN PATENT DOCUMENTS

| | | |
|---|---|---|
| 421261 | 8/1968 | Australia . |
| 17087 | 8/1968 | Australia . |
| 488646 | 10/1975 | Australia . |
| 44494 | 2/1979 | Australia . |
| 82742 | 7/1979 | Australia . |
| 0003853 | 9/1979 | European Pat. Off. . |
| 3420372 | 12/1985 | Fed. Rep. of Germany . |
| 2228113 | 11/1974 | France . |
| 2444721 | 7/1980 | France . |

OTHER PUBLICATIONS

Chemical Abstracts, 93, (1980), 208072 (Davey, et al.), "The Direct Smelting of Zinc Sulphide Concentrate".

*Primary Examiner*—Melvyn J. Andrews
*Attorney, Agent, or Firm*—Larson and Taylor

[57] ABSTRACT

A smelting process of superior energy efficiency, particularly suitable for the extraction of zinc, but also of lead and copper from raw materials comprising sulphide concentrates, and oxidized metalliferous materials, is carried out by establishing at least one oxidation zone and at least one reduction zone in a furnace, each zone comprising a slag bath and a gas space; the gas spaces of the oxidation and reduction zones being separated by a partition; feeding raw materials comprising metal sulphides, together with fluxes, to the or each oxidation zone, and feeding oxygen or oxygen-rich gas into the slag bath in the or each oxidation zone to oxidize metal compounds therein and produce an off-gas containing $SO_2$; transferring metal-oxide-bearing slag from at least one oxidation zone to at least one reduction zone; introducing coal into the or each reduction zone to reduce metal oxides therein, and produce gases containing carbon monoxide and hydrogen; introducing a controlled stream of oxygen into the or each reduction zone, the amount of oxygen in the said stream being sufficient to partly post-combust carbon monoxide and hydrogen, thereby producing heat which is transferred back to the slag bath in the reduction zone, while leaving the gases sufficiently reduced to ensure that reduced metal is not re-oxidized; and recovering reduced metal from at least one reduction zone.

4 Claims, 4 Drawing Sheets

ZINC SMELTING PROCESS USING OXIDATION ZONE AND REDUCTION ZONE

SUMMARY OF THE INVENTION

Figure 1:
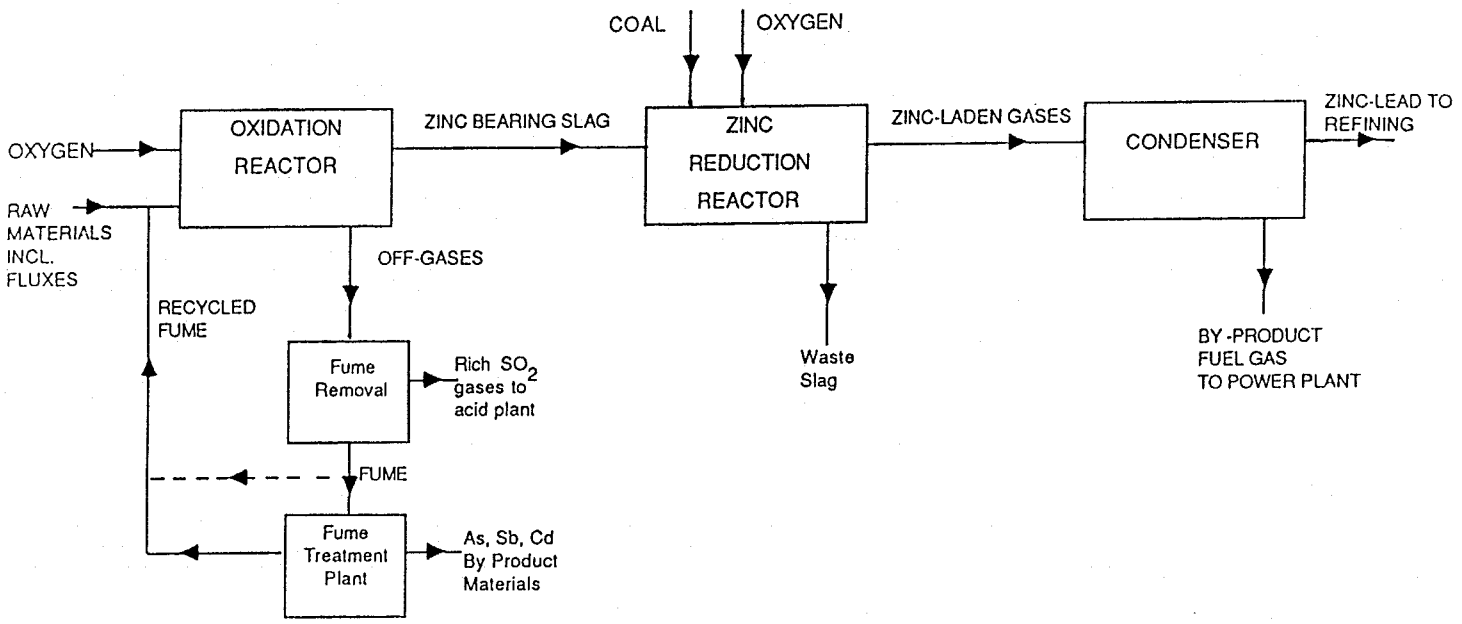

This invention relates to a pyrometallurgical smelting process for the extraction primarily of zinc, but also of lead and copper from raw materials consisting of sulphide concentrates, particularly mixed sulphide concentrates and oxidised metalliferrous materials.

The process uses oxygen to oxidise the sulphides in the charge, with the exothermic heat released melting the charge to form a high zinc oxide molten slag. Coal is used as the reductant together with additional coal and oxygen to provide supplementary heat to the reduction stage. Zinc and lead vapours from the reduction stage are condensed to produce liquid metals. The process is amenable to a high degree of control and to automation.

The process eliminates the need for sintering or roasting operations and gives high metal recoveries.

BACKGROUND TO THE INVENTION

Historically, zinc has been produced in retorts, in electrolytic cells and in the Imperial Smelting Furnace (ISF). Today almost all zinc is produced by the electrolytic process or the ISF process. The ISF is used to treat dirty and low grade concentrates as well as some secondary materials. To some extent its economic viability is threatened because of its large usage of high cost coke, its low thermal efficiency and the need for separate sintering and refining stages. To an extent the economics of the electrolytic process are dependent on low electricity costs. The process also produces a residue that presents disposal problems.

This invention constitutes an advantageous alternative to the ISF and has the advantages of better utilisation of exothermic heats of reaction, use of low cost coal as reductant instead of metallurgical coke, and production of a high calorific value by-product gas.

The KIVCET process (Australian Pat. Nos. 421,261; 456,550) has been used commercially to treat dirty copper concentrates, and in a modified form has been piloted to treat lead concentrates including some containing amounts of zinc. It has not been applied commercially to materials in which zinc is the predominant metal.

The copper variant of the KIVCET process involves cyclone smelting of dried concentrates with oxygen to produce a molten bath containing any lead and zinc present in oxidised form as a slag and the copper as a matte. The sulphur dioxide off-gas is of high tenor and can be used for acid production. Slag and matte pass under a partition wall into an electrothermic furnace zone where reducing agents are added, to the bath. Heat is provided by electricity. Lead metal may be recovered from the slag, zinc may be fumed off and copper matte remains unchanged. The latter is transferred to a converter to produce blister copper.

The KIVCET process for lead is similar, but is not considered suitable for adaptation to predominantly zinc containing materials unless low cost electricity is available on account of the high energy requirements involved.

The Outokumpu company in Finland has investigated the smelting of lead and is also studying the fuming of zinc from slag produced in lead smelting. According to Outokumpu (Australian Pat. No. 501,911), concentrates are flash smelted to produce molten lead metal and a liquid slag which are passed to an electrothermic furnace where zinc is fumed off by injecting fine coal entrained in nitrogen. When applying this process to materials containing high percentages of zinc, a large amount of heat is produced as a result of the oxidation of zinc sulphide. In flash smelting, this heat is immediately used up in the volatilisation or large amounts of lead which gives rise to a large unwanted circulating furnace load.

In the QSL process (U.S. Pat. No. 4,266,971), developed by Lurgi in West Germany, a molten bath of slag is fed with pelletised lead concentrates. The pellets enter the bath into which oxygen is injected. A high lead oxide slag is produced which is subsequently reduced to metallic lead in a second part of the furnace by injecting coal. As far as is known, this process has not been developed for the fuming of zinc.

The ISASMELT process (Australian patent application No. 90762/82), is another bath smelting process for the smelting of lead concentrates. It consists of adding lead sulphide to a molten slag, injecting air into the slag bath to agitate the bath and to oxidise the lead sulphide to lead oxide and subsequently reduce the oxide to lead metal. Any zinc in the lead concentrates and remaining in slag, may be recovered by the addition of a slag fuming stage to the process.

A process which is aimed at predominantly zinc containing raw materials has been proposed by Davey and Yazawa. The process concept involves the following reaction at elevated temperatures $$ZnS+O_2=Zn+SO_2$$

As this reaction is endothermic, addition of carbonaceous fuel is required resulting in a mix of carbon oxides and sulphur dioxide in the off-gases. This makes it difficult to recover the heat value in any unburnt carbon monoxide and may lead to thermal inefficiency. There is also a potential problem of recovering zinc vapour from the complex gas stream.

DESCRIPTION OF THE INVENTION

The invention involves the oxidation of zinc sulphide concentrates in a molten slag bath with industrial oxygen to produce an oxide slag, followed by reduction with coal to fume off metallic zinc which is collected in a lead splash condenser.

The oxidation reactions are exothermic and when using dry sulphide feed materials, oxidation is autogenous. The reactions are typified by $$2ZnS+3O_2=2ZnO+SO_2$$

Most importantly the excess heat of oxidation of sulphide materials is used to melt the oxidised zinciferous materials and fluxes and to cause them to enter the oxide slag. During oxidation, volatile impurities, such as arsenic, antimony and cadmium, are eliminated in the fume phase.

The oxidation stage may be modified by including and maintaining a molten sulphide phase (matte). Such matte phase aids in the oxidation of slower reacting feed materials, e.g. coarser particles. If there is sufficient copper in the feed materials the production of a copper matte or copper metal may be warranted.

Reduction of zinc oxide to zinc vapour is carried out under strongly reducing conditions. The reduction reactions are endothermic. Thus additional coal must be burnt in the slag bath with a limited oxygen input so as to ensure that the combustion product is principally CO.

Additional heat is introduced into the slag bath by partially burning the off-gases above the slag bath. To this end heat is transferred to the bath while still maintaining sufficiently reducing conditions to prevent the reversion of zinc to zinc oxide. Such "post-combustion" can be achieved by injecting oxygen into the top layers of the bath or the top space above the slag bath so as to burn as much of the CO as possible while still maintaining a suitable reversion temperature. This would give a $CO/CO_2$ ratio of about 2.

Some of the heat released in the post combustion step that is not transferred back to the slag bath can be utilised to reduce recycle zinc and lead materials by contacting such materials with the hot reducing off-gases before they enter the condenser. The post-reduction step can be used to adjust the off-gas composition and temperature to approach the zinc reversion conditions.

The volume of discard slag produced on reduction in a reduction zone or reactor can easily be lessened-and so lessen zinc losses and flux requirements-by adding a further stage to reduce iron from part of the discard slag stream. The reduced iron is then returned to the preceding zinc reduction stage where it will contribute to the reduction of zinc oxide. The slag from the iron reduction stage is returned to the oxidation stage to flux iron contained in fresh feed materials thereby lessening the required quantity of flux.

Any iron formed is not molten at 1350° C. unless the slag is reduced to such an extent that additional carbon dissolves in the iron to lower its melting point. It is preferable, however, to have a bath of molten copper in the iron reduction reactor to dissolve the iron produced and to return it to the zinc reduction stage in the form of a metallic solution.

FIG. 1 shows a flowsheet for the process with stages for oxidation, reduction plus post combustion, condensation and impurity bleed from recycle fume.

Essentially the slag comprises FeO, $Fe_2O_3$, CaO, $SiO_2$ $Al_2O_3$, PbO, ZnO components; a typical compositon would be 20% FeO, 15% CaO, 20% $SiO_2$, 5% $Al_2O_3$, 10% PbO, 30% ZnO.

The oxidation reaction is generally driven at a temperature of about 1350° C. The feed materials (concentrates, residues, reverts etc.) are injected below the surface of the molten slag bath or by feeding them onto the surface of slag baths. Oxygen is injected through tuyeres or lances.

Primary oxidation will occur in the course of submerged combustion of particulates at or near the tuyere tip. Injected oxygen will also oxidise some of the iron oxide in the slag from ferrous to ferric. Part of the sulphides added will be oxidised by the ferric iron in the slag. The reaction sequence is believed to be as follows In the vicinity of the tuyere or tuyere plume $$2ZnS+3O_2=2ZnO+2SO_2 \quad (1)$$

$$12FeO+3O_2=6Fe_2O_3 \quad (2)$$

In the bulk of the slag $$ZnS+3Fe_2O_3=ZnO+6FeO+SO_2 \quad (3)$$

In one important aspect is it desirable to maintain conditions such that zinc oxide concentration in solution is at a maximum to lessen the slag volume and hence the loss of zinc in slag. To achieve this the temperature must be kept as high as possible, however, too high a temperature will result in excessive fuming, especially in the presence of lead compounds. A temperature of 1350° C. has been found particularly suitable.

In another aspect the oxidation potential of the slag is significant. If the slag is excessively oxidised in the presence of high zinc concentrations then a spinel phase is precipitated, making the zinc viscous and unworkable. It is necessary, in accordance with the invention to inject the concentrates and oxygen in such a way that reaction (2) is minimised. Alternatively concentrates in close proximity to the oxygen may be injected through the same tuyere. This is possible in the presence of liquid matte and copper phases and will be described later.

The fume trom the oxidation stage is separated from the $SO_2$ gases. The latter are usually greater than 50% tenor due to the use of oxygen and may readily be used for making sulphuric acid. The fume contains a high proportion of volatile impurities, such as As, Sb, Cd, Se. All the fume or a bleed stream of it can be treated hydrometallurgically to remove these impurities before returning the lead and zinc fume residues to the process.

The liquid high zinc slag from the oxidation stage is passed to the reduction stage where coal and oxygen are injected below its surface. The reactions occurring are believed to be $$ZnO+C=Zn+CO \quad (4)$$

$$2CO+O_2=2CO_2 \quad (5)$$

The practice of injecting coal and air in batch slag fuming processes is well known and needs no description here. The continuous process of the invention uses oxygen or a rich oxygen/air mix instead of air to lessen the volume of off-gases and to yield a greater calorific value by-product gas which can be used to advantage as an energy source for zinc refining or for production of oxygen.

As is generally known the reduced gases will leave the slag bath and be either, fully oxidised above the bath to form zinc oxide as in zinc slag fuming, or be condensed in a lead splash condenser as in the ISF process. It is a feature of the present process to introduce a controlled stream of oxygen into the upper part of the reduction stage or reactor so as to partly post-combust the contained CO and $H_2$ to $CO_2$ and $H_2O$, but to still leave the gases sufficiently reduced to ensure that the zinc is not oxidised to zinc oxide. Maintenance of a residual $CO/CO_2$ ratio of 2 will ensure that the zinc is not oxidised as the gases pass to the lead splash condenser. Zinc is recovered from the condenser and refined by distillation as in the ISF process. The gases from the condenser have a higher fuel calorific value than the gases from an ISF as they are not diluted by a large volume of nitrogen and may be used as an energy source for an associated oxygen plant.

It should be noted particularly that the aforesaid post-combustion is carried out in such a way that most of the heat of combustion is transferred back to the slag bath. This provides some of the heat required for the endothermic reduction reactions and for the volatilisation of zinc. It thereby reduces the amount of coal that would otherwise need to be burnt with additional oxygen to provide the heat. Such post combustion may be brought about by injecting oxygen into the top space above the slag bath and transferring heat back to the slag bath by radiation and convection.

The temperature of the gases leaving the reduction reactor will be significantly higher than the slag bath temperature as they will contain portion of the heat liberated in the post-combustion step. A technique can be adopted whereby fine oxidic zinc and lead recycle materials, produced in the condensation, refining and fume treatment stages of the process of the invention, are injected into the hot gas stream. Such oxides are reduced to metal vapours, by the CO present in the gas together with sensible heat in the gases. The net effect of post-reduction is to improve the energy efficiency of the process by using some of the chemical energy and lowering the temperature of the gases to just above the reversion temperature; this also reduces the heat load on the condenser.

As an alternative to post combustion, a similar heat gain or release may be achieved by injecting oxygen into the slag bath at different positions to those at which coal is injected, thus providing strong local reducing conditions at coal injection positions and producing heat at the more oxidising conditions near the oxygen injection points.

The slag (tail slag) produced in the reduction zone or reactor has been found to contain only a few percent of zinc and can be discarded.

Figure 2:
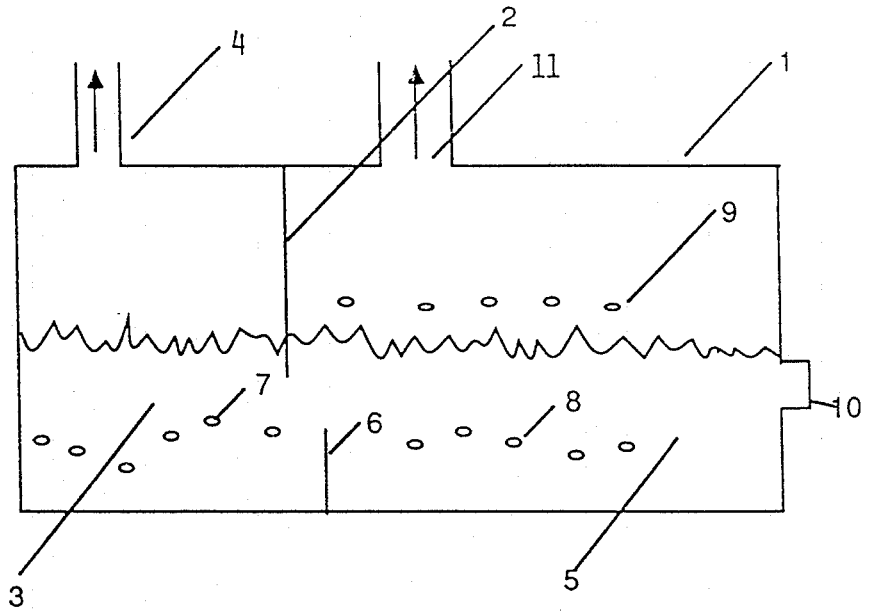

FIG. 2 shows a conceptual diagram of one type of reactor for carrying out the process described above. The reactor 1 is a water-cooled refractory-lined vessel. Partition 2 in the gas space above the slag bath separates the $SO_2$ gases leaving the oxidation zone 3 through off take 4 from the zinc laden gases leaving the reduction zone 5. Optionally a partition 6 in the slag bath may be provided between the oxidation and reduction zones of the bath. Additional partitions in the slag bath could be provided to give multiple reduction zones. Tuyeres 7 serve the injection of oxygen and/or charge materials, tuyeres 8 the injection of oxygen and/or coal, tuyeres 9 are for effecting post-combustion. Waste slag is withdrawn through a continuous tapper 10. Zinc laden gas passes out through off-take 11. Other arrangements or even a series of separate reactors could achieve the reaction sequences of this method.

The charge and oxygen are injected into each zone through tuyeres positioned below the slag level. Post combustion ports are positioned above the slag level in the reduction zone. Slag is withdrawn from the reduction zone through a continuous tapper.

Figure 3:
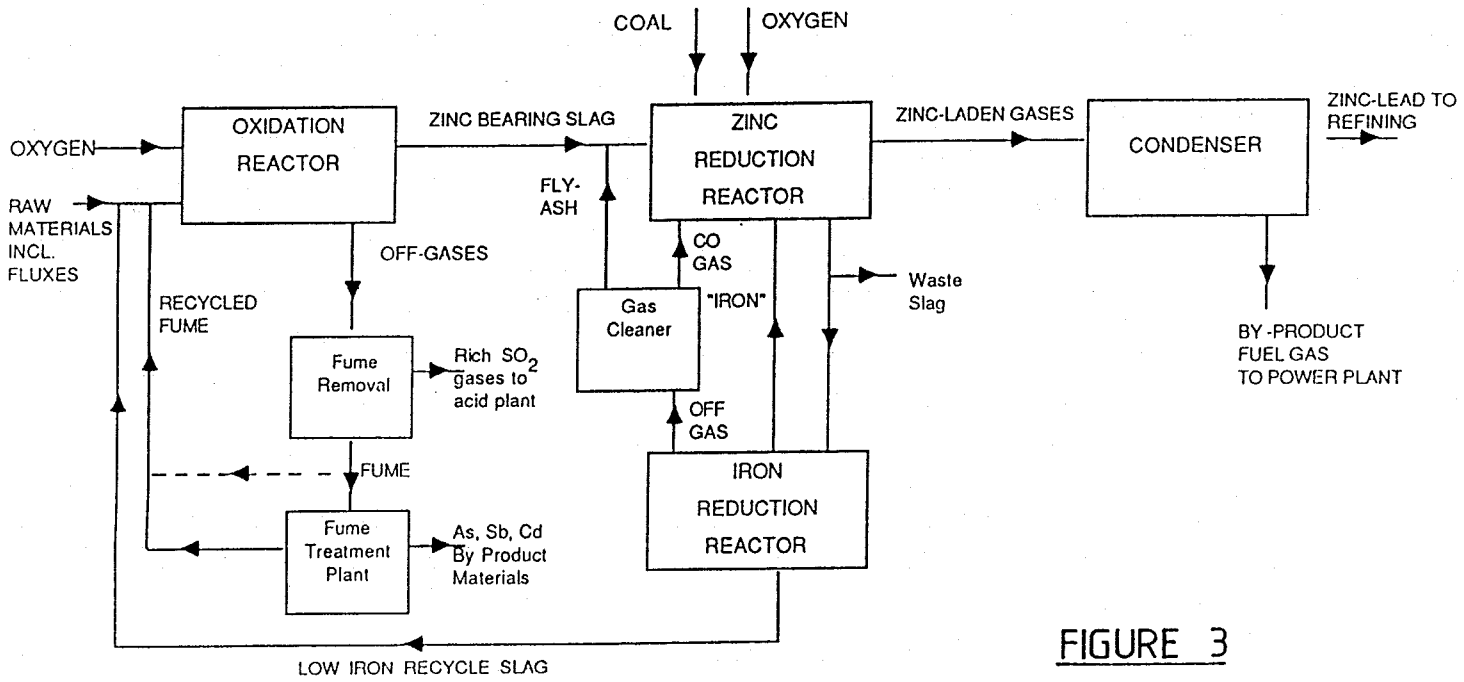

FIG. 3 shows a flowsheet for a variant of the process which includes an iron reduction stage and a low iron slag recycle. The oxidation and zinc reduction stages are as described for FIG. 1, with the following additions:

The tail slag from the zinc reduction reactor is split into two streams. One stream is discarded as before. It provides a discard for iron oxide and other gangue materials introduced with the feed materials and coal. The other stream is passed to a further stage of reduction where coal and oxygen are injected to reduce the iron oxide in the slag to iron metal. In another version of this variant a molten copper phase is provided in the reduction zone to dissolve the metallic iron produced and convey it in molten form to a zinc reduction furnace or reactor.

The iron dissolved in copper will act as a reductant for the zinc and be reoxidised to iron oxide. The iron acting as a reductant in this way will replace coal that would otherwise have been added as reductant. The overall effect is that the coal requirement remains the same with the addition of the iron reduction reactor, except for a small increase to account for heat losses from the additional reduction furnace. The iron depleted copper is recycled to an iron reduction reactor to collect more iron. The reaction sequence is believed to be In the iron reduction reactor $$(FeO)slag + C = CO + (Fe)copper \quad (6)$$

In the zinc reduction reactor $$(Fe)copper + (ZnO)slag = (FeO)slag + (Zn)gas \quad (7)$$

It is economically important that the off-gas from the iron reduction reactor be used effectively. By putting the coal into the iron reduction reactor instead of the zinc reduction reactor, the two beneficial effects described below are largely lost (1) The effect of the combustion gases to dilute the zinc concentration in the zinc reduction reactor off-gas and so provide a lower equilibrium zinc concentration in the waste slag (2) The effect of the CO gas to release heat back to the slag bath in the zinc reduction reactor by post-combustion above the bath.

To regain corresponding benefits when an iron reduction stage is included it is necessary to pass the iron reduction off-gas back to the zinc reduction reactor. This can be done by cleaning the gases and injecting them into the zinc reduction reactor slag bath.

One aspect mentioned earlier as an aid to control in the oxidation zone was the presence of a molten matte phase. A cuprous sulphide rich matte phase is believed to play two roles in controlling the chemistry in the oxidation zone or reactor.

Firstly, the matte has the capacity to dissolve the sulphide concentrates, resulting in a lower sulphur content in the slag phase removed from the reaction zone. This is thought to be due to the matte phase trapping and dissolving any unreacted zinc sulphide concentrate particles. In the absence of the matte phase these particles surrounded by a gas envelope of $SO_2$ would be dispersed through the slag phase as discrete entities as they react with the $Fe_2O_3$ in the slag (refer Reaction (3)).

Secondly, the equilibrium, between copper matte, copper metal and $SO_2$ gas, buffers the oxidation potential at a level at which fuming is not excessive and spinels associated with slag iron will not form. It buffers by reversibly producing copper metal if the oxygen addition is excessive, rather than oxidising the iron in the slag to ferric oxide and precipitating spinel. Spinel phase precipitation can cause increased viscosity and slag foaming. If there is an inadequate oxygen supply the copper metal will reform cuprous sulphide. Under such conditions the matte also has the above mentioned capacity to dissolve the sulphide concentrates added rather than their being dispersed through the slag and giving rise to a high residual sulphur content in the slag.

The reaction sequence described above could be summarised as below

With balanced oxygen addition $$2ZnS+3O_2=2(ZnO)slag+2SO_2 \quad (8)$$

With excessive oxygen $$(Cu_2S)matte+O_2=2Cu+SO2 \quad (9)$$

$$2(ZnS)matte+3O_2=2(ZnO)slag+2SO_2 \quad (10)$$

With insufficient oxygen $$2Cu+2ZnS+O_2=(Cu2S)matte+2(ZnO)slag \quad (11)$$

$$2ZnS=2(ZnS)matte \quad (12)$$

It should be noted that, while reaction (8) represents the overall reaction for balanced oxygen supply, reactions (9–12) can also be occuring simultaneously.

A possible disadvantage of using matte in the oxidation reactor is that there will be an equilibrium level of about 5–10% Cu in the slag. This will need to be reduced in the zinc reduction reactor to recover the copper. The ratio of copper to zinc in the slag is about 1:4. If the feed materials have a lower ratio than this then the copper reduced from slag has to be returned to the oxidation reactor to maintain the matte phase. The slag will build up to the same Cu:Zn ratio and so imposes an additional reduction load on the process. If the feed materials have a higher ratio of copper to zinc, then a matte or preferably a copper metal phase is produced which is returned to the oxidation reactor.

If lead is present in the feed materials, it will mainly oxidise into the slag phase. Some will report in fume which is recycled to the oxidation zone. Lead in slag is reduced in the reduction zone; for low ratios of lead to zinc it will be volatilised along with the zinc; at higher lead to zinc ratios, a separate lead bullion phase will be produced which can be tapped from the reactor for further processing to refined lead.

Precious metals report in the molten matte or metal phases tapped and can be recovered from them by traditional methods. In the absence of matte or metal co-products, there will be no collector for the precious metals. The last variant described here is therefore most suitable whenever significant quantities of precious metals are present in the process.

EXAMPLES

Example 1

This example is of a small scale experiment representative of the oxidation stage of the process of the invention (i.e. no matte phase present).

A starting bath of 1733 gram of slag was melted in an alumina crucible. In commercial operation a suitably refractory lined steel vessel would be used. Oxygen and zinc concentrates were injected through a lance into the slag bath at a rate of 11 gram per minute and 5 normal litres per minute respectively for 60 minutes. The reactor was held at 1350° C. Fume from the reactor was caught in a gas filter. The final slag and fume were weighed and analysed. The mass balance was as follows:

| Material | Mass g | % Zn | % Pb | % Cu | % Fe | % $SiO_2$ | % CaO | % $Al_2O_3$ | % S |
|---|---|---|---|---|---|---|---|---|---|
| Zn—Pb conc | 686 | 35 | 16 | 0.4 | 13 | 0.8 | 0.2 | 0.2 | 31 |
| Start slag | 1733 | 22 | 0.6 | 0.44 | 19.2 | 26.8 | 11.4 | 6.2 | 0.7 |
| Final slag | 1880 | 27.7 | 3.6 | 0.41 | 18.7 | 18.6 | 8.2 | 4.8 | 2.4 |
| Fume | 113 | 17.7 | 56 | 0.05 | 0.3 | — | — | — | 6.4 |

When oxygen alone was blown into a slag bath of similar composition to the final slag above the sulphur content of the slag decreased to 0.6%.

The experiment indicates that sulphur is removed from the bath at a practical intensity equivalent to 0.35 tonne per hour of feed per tonne of bath capacity while maintaining a fluid slag of relatively high zinc concentration.

Example 2

This example is of a small scale experiment representative of the reduction stage of the process of the invention.

As stated zinc oxide slags are reduced in batch slag fuming processes using coal and air to produce zinc oxides. The method of the invention produces elemental zinc vapour which is then condensed to liquid zinc. The invention uses coal and oxygen or rich oxygen/air mixes, the latter to reduce the quantity of gas, and to increase its calorific value. This raises the zinc content of the off-gas from the slag bath as demonstrated below A starting slag bath of 300 g of low zinc content (2% Zn) was prepared and held at 1300° C. Oxygen plus coal and nitrogen were injected through a lance below the surface of the slag.

Oxygen feed rate was 1.4 l min., nitrogen feed rate (carrier gas for the coal) 1.5 l min., and the coal feed rate 1.5 g/min.

Continuous feeding of high zinc slag was simulated by adding 25 g of slag containing 18% Zn every 3 min. Under these conditions, the slag bath equilibrated at 3.4% Zn after 30 min.

Of the 1.5 g/min of zinc added in feed slag, 0.3 g/min reported in the slag bath and 1.2 g/min reported in the off-gas. The resultant off-gas was calculated to contain 10% Zn at a $CO/CO_2$ ratio of 1:4.

Example 3

The following table gives examples of a range of high zinc slag compositions that were found to be fluid at a temperature of 1350° C., and at oxidation potentials relevant to the desulphurisation reactions as in reaction (1) page 6. Fluidity was measured by a Herty fluidity gauge and found to very suitable for operation of the process. They were also judged by experience to be suitably fluid.

| No. | Temp. C | % ZnO | % PbO | % Fe tot | $Fe^{3+}/Fe^{2+}$ | % $SiO_2$ | % CaO | % $Al_2O_3$ |
|---|---|---|---|---|---|---|---|---|
| 1 | 1350 | 48.8 | 0.3 | 7.4 | 0.25 | 29.9 | 6.6 | 4.8 |
| 2 | 1350 | 49.1 | 1.0 | 7.4 | 3.5 | 24.0 | 10.3 | 3.3 |
| 3 | 1350 | 38.6 | 14.1 | 19.4 | 0.49 | 11.4 | 2.7 | 4.3 |

-continued

| No. | Temp. C | % ZnO | % PbO | % Fe tot | $Fe^{3+}/Fe^{2+}$ | % $SiO_2$ | % CaO | % $Al_2O_3$ |
|---|---|---|---|---|---|---|---|---|
| 4 | 1280 | 38.3 | 12.3 | 13.7 | 0.23 | 18.1 | 7.3 | 3.8 |
| 5 | 1350 | 34.2 | 11.0 | 20.9 | 0.7 | 11.4 | 5.2 | 7.1 |

Example 4

Figure 4:
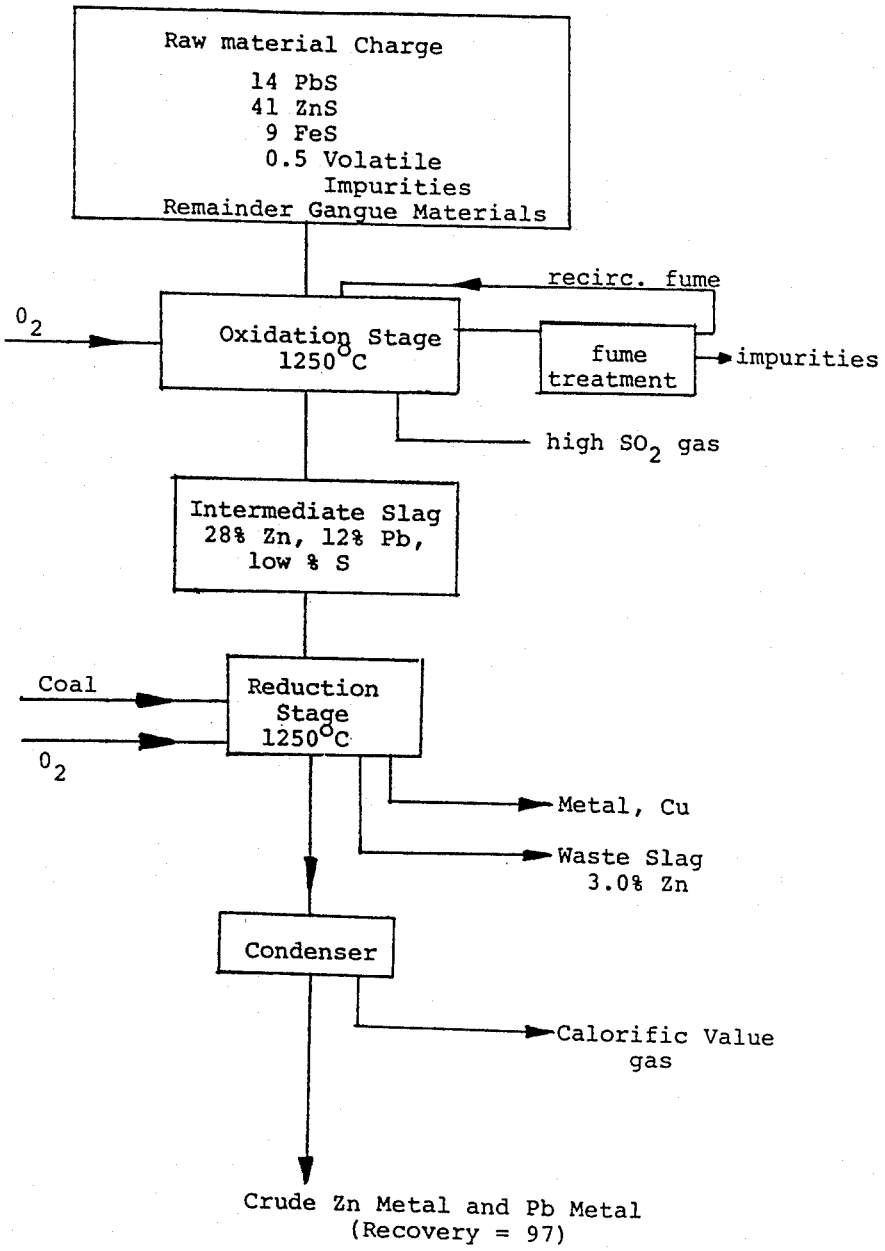

This example is illustrated in the attached flow sheet, FIG. 4.

52 kg of a charge, of dried mixed lead and zinc sulphide concentrates and recirculated fumed material and fluxes, containing PbS 14%, ZnS 41%, FeS 9%, Volatile Impurities 0.5%, Remainder gangue materials was injected into a slag bath located in a small hearth furnace with the amount of oxygen injected totalling 16 kg. The exothermic heat of the oxidation reactions melted the incoming materials and resulted in a bath temperature of about 1250° C.

The slag produced during the oxidation stage contained 28% Zn and 12% Pb, with about 30% of the lead reporting into fume. The slag of this composition was quite fluid at the temperature of 1250° C.

This hot slag was passed to a separate vessel for reduction. Oxygen was injected into the slag bath and 11 kg of coal added as a reductant and to provide heat to keep the bath at 1250° C., and maintain strongly reducing conditions. The lead and zinc was reduced to metal and volatilized from the bath. Oxygen was introduced above the bath via a lance to burn some of the CO to $CO_2$ and reverberate the heat released back into the slag bath. The $CO/CO_2$ ratio in the off-gas was kept above 2, so that the lead and zinc in the off-gas could be recovered in metallic form in a lead splash condenser, and to provide a gas with a high calorific value for subsequent use as a heating fuel. The zinc content of the waste slag was 3%, accordingly 97% of the zinc was recovered. Recovery of lead was practically complete with only some 0.1% reporting in the waste slag.

We claim:

1. A zinc smelting process which comprises (a) establishing at least one oxidation zone and at least one reduction zone in a furnace each zone comprising a slag bath and a gas space; the gas spaces of the oxidation and reduction zones being separated by a partition;

(b) maintaining a molten matte phase rich in cuprous sulphide in the or each oxidation zone, feeding raw materials comprising zinc sulphides and iron sulphides, together with fluxes, to the or each oxidation zone, and feeding oxygen or oxygen-rich gas into the molten bath in the or each oxidation zone to oxidise metal compounds therein to produce a slag bearing zinc oxide and iron oxide and to produce an off-gas containing fume and $SO_2$, said fume containing zinc and other volatiles;

(b.1) removing from said oxidation zone the off-gas produced in stp (b), removing fume from said off-gas, separating volatiles other than zinc from the removed fume to produce a zinc-containing fume residue, and recycling said zinc-containing fume residue to the oxidation zone;

(c) transferring zinc oxide-bearing slag from at least one oxidation zone to at least one reduction zone;

(d) introducing coal into the or each reduction zone to reduce zinc oxide present in said zinc oxide-bearing slag to produce reduced zinc, discard slag, and reducing gases containing carbon monoxide and hydrogen, said discard slag containing iron oxide;

(e) introducing a controlled stream of oxygen into the or each reduction zone, the amount of oxygen in the said stream being sufficient to partly post-combust said carbon monoxide and hydrogen, thereby producing heat which is transferred back to the slag bath in the reduction zone, while leaving said reducing gases sufficiently reducing to ensure that zinc vapor is not re-oxidised;

(f) recovering reduced zinc from at least one reduction zone; and (g) removing discard slag from at least one reduction zone, dividing the removed discard slag into two streams, passing one of the streams to waste, passing the other stream to an iron reduction reactor to reduce iron oxide present in said discard slag to produce iron metal, off-gases, and a low-iron slag, recycling iron metal to the zinc reduction zone, and recycling low-iron slag from the reduction reactor to the oxidation zone.

2. Process according to claim 1 further comprising providing a molten copper phase in said iron reduction reactor to dissolve the metallic iron producedd therein and to convey it in molten form to the zinc reduction zone.

3. Process according to claim 1 in which off-gases from the iron reduction reactor are cleaned and recycled to the zinc reduction zone slag bath.

4. Process according to claim 1 in which the slag baths of the oxidation and reduction zones are separated by a partition.

* * * * *